US006516474B2

(12) United States Patent
Chou

(10) Patent No.: US 6,516,474 B2
(45) Date of Patent: Feb. 11, 2003

(54) SWIMMING GOGGLES WITH IMPROVED WEARING COMFORT AND WIDER APPLICATION

(76) Inventor: Terry Chou, No. 12, Hsin Ho Herng Road, Tainan City (TW)

( * ) Notice: Subject to any disclaimer, the term of this patent is extended or adjusted under 35 U.S.C. 154(b) by 0 days.

(21) Appl. No.: 09/843,567

(22) Filed: Apr. 27, 2001

(65) Prior Publication Data

US 2002/0157174 A1 Oct. 31, 2002

(51) Int. Cl.[7] ..... A61F 9/02
(52) U.S. Cl. ..... 2/428; 2/452
(58) Field of Search ..... 2/428, 430, 439, 2/440, 452; 351/43

(56) References Cited

U.S. PATENT DOCUMENTS 4,556,995 A * 12/1985 Yamamoto ..... 2/439
5,581,822 A * 12/1996 Tagyo ..... 2/428
5,603,125 A * 2/1997 Chou ..... 2/428
5,901,381 A * 5/1999 Nelson ..... 2/209.13
5,946,728 A * 9/1999 Tane ..... 2/171
6,024,102 A * 2/2000 Huang ..... 132/273
6,047,709 A * 4/2000 Tu ..... 132/275
6,098,205 A * 8/2000 Schwartz et al. ..... 2/428
6,289,903 B1 * 9/2001 Haufler ..... 132/275
6,349,420 B1 * 2/2002 Chiang ..... 2/428
6,382,218 B1 * 5/2002 Cheng ..... 132/275

* cited by examiner

*Primary Examiner*—John J. Calvert
*Assistant Examiner*—Katherine Moran
(74) *Attorney, Agent, or Firm*—Charkes E. Baxley

(57) ABSTRACT

A pair of swimming goggles comprises two lenses made of rigid material and two frames made of a soft material. Each lens includes a main portion and an engaging portion. The main portion is larger than a human eye socket. The frames are connected by a connecting portion therebetween. Each frame includes a ring portion for receiving the main portion of an associated lens. Each frame further includes a padding portion on an inner side thereof. The padding portion is engaged with the engaging portion of the associated lens and larger than the human eye socket. A space is defined between the two padding portions and located corresponding to a wearer's nose. Each padding member is in intimate contact with an area surrounding the wearer's eye socket and a lateral nose area of the wearer and not in contact with an upper portion of the wearer's nose.

2 Claims, 11 Drawing Sheets

SWIMMING GOGGLES WITH IMPROVED WEARING COMFORT AND WIDER APPLICATION

BACKGROUND OF THE INVENTION

1. Field of the Invention

The present invention relates to a pair of swimming goggles with improved wearing comfort and wider application, and more particularly to a pair of swimming goggles that provides improved wearing comfort and that can be used by wearers with different nose bridge contours.

2. Description of the Related Art

FIGS. 7 and 8 of the drawings illustrate a pair of conventional swimming goggles that includes two lenses 1', two padding members 2', a bridge 3', and a head strap 4'. Each lens 1' is made of a transparent rigid material and includes a first connecting portion 11' on an inner end thereof for engaging with the bridge 3' and a second connecting portion 12' on an outer end thereof for engaging with the head strap 4'. Each padding member 2' is made of a soft material and includes a padding portion 21' on an inner side thereof for intimate contact with the eye socket of a wearer. However, different wearers have different eye socket contours. The wearer often feels uncomfortable as a result of intimate contact between the eye sockets and the padding portions 21 after a long-term wearing.

FIG. 9 illustrates another pair of conventional swimming goggles comprising a lens unit 5', a frame 6', and a head strap 7'. The lens unit 5' includes two lenses 51' connected by a connecting portion 52'. The frame 6' is integrally formed by a soft material and includes two ring portions 61' each for receiving an associated lens 51' and a connecting portion 62' between the ring portions 61'. The frame 6' further includes a padding portion 63' extending rearward therefrom for intimate contact with an area surrounding the eye sockets and the upper portion of the nose of the wearer. The connecting portion 62' of the frame 6' is located inside the connecting portion 52' of the lens unit 5'.

Referring to FIG. 10, most of the padding portion 63' is in intimate contact with the flat area surrounding the wearer's eye sockets. A lower middle portion "a" of the padding portion 63' is intimate contact with the upper portion of the wearer's nose. Since the nerves in the outer portion of the human eye sockets are less sensitive, the wearer will not feel too much pressure even after long-term wearing of the swimming goggles.

However, as illustrated in FIG. 11, the height of the wearer's nose varies. For example, the nose of an Asian is generally lower than that of a European or American. Thus, a pair of swimming goggles cannot fit all users. Leakage occurs if the wearer's nose is gradual and the wearer will feel pressure at the nose if the wearer's nose is steep. In addition, the upper end of the nose bone is steep such that the head strap must be pulled to an extent to exert a relatively larger force for assuring waterproof effect, yet this discomforts the nose.

SUMMARY OF THE INVENTION

It is the primary object of the present invention to provide a pair of swimming goggles that provides improved wearing comfort and that can be used by wearers with different nose contours.

In accordance with a first aspect of the invention, a pair of swimming goggles comprises:

two lenses made of a rigid material and each including a main portion and an engaging portion, the main portion being larger than a human eye socket; and two frames made of a soft material and connected by a connecting portion therebetween, each said frame including a ring portion for receiving the main portion of an associated said lens, each said frame further including a padding portion on an inner side thereof, the padding portion being engaged with the engaging portion of the associated lens and larger than the human eye socket, a space being defined between the two padding portions and located corresponding to a wearer's nose;

wherein each said padding member is in intimate contact with an area surrounding the wearer's eye socket and a lateral nose area of the wearer and not in contact with an upper portion of the wearer's nose.

In accordance with a second aspect of the invention, a pair of swimming goggles comprises:

two lenses made of a rigid material and connected by a connecting portion therebetween, each said lens being larger than a human eye socket; and two frames made of a soft material, each said frame receiving an associated said lens, each said frame further including a padding portion on an inner side thereof, the padding portion being larger than a human eye socket ,a space being defined between the two padding portions and located corresponding to a wearer's nose;

wherein each said padding member is in intimate contact with an area surrounding the wearer's eye socket and a lateral nose area of the wearer and not in contact with an upper portion of the wearer's nose.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
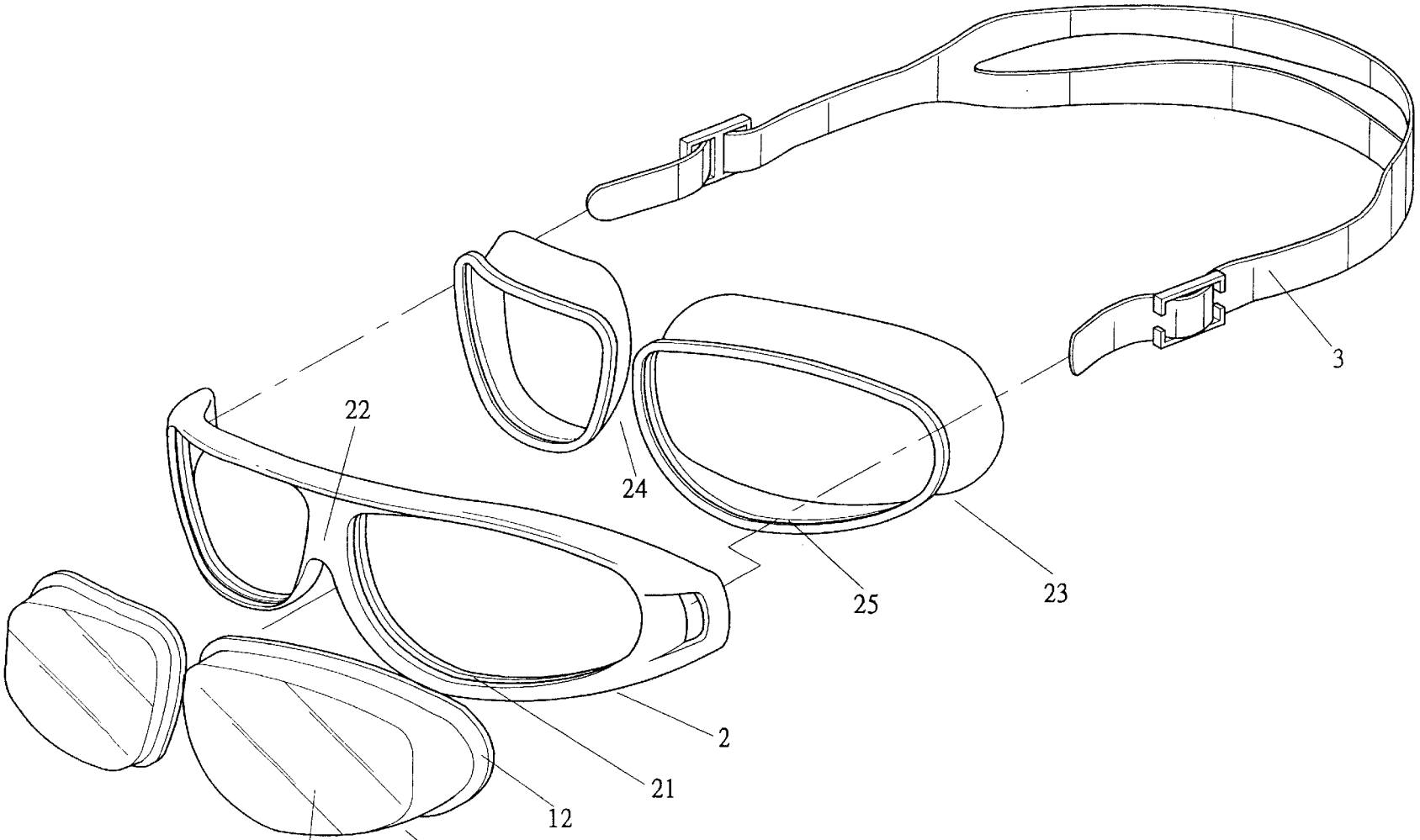
FIG. 1 is an exploded perspective view of a pair of swimming goggles in accordance with the present invention.
Figure 2:
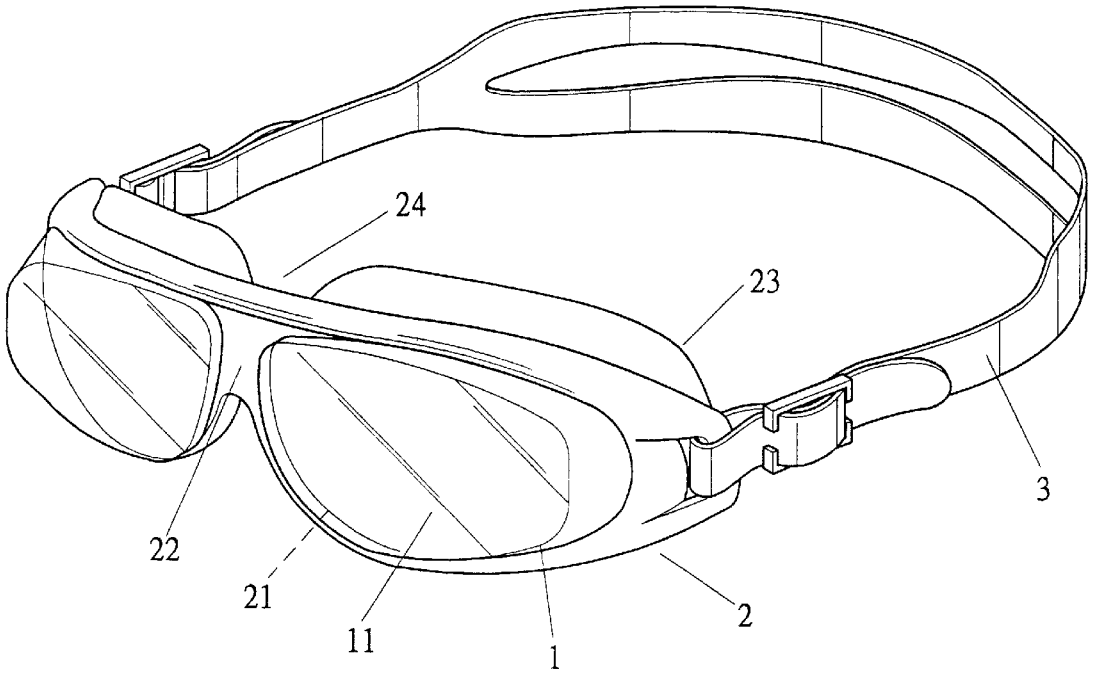
FIG. 2 is a perspective view of the pair of swimming goggles in FIG. 1.

Referring to FIGS. 1 through 6 and initially to FIGS. 1 and 2, a pair of swimming goggles in accordance with the-present invention generally includes two lenses 1, two frames 2, and a head strap 3. Each lens 1 is made of a rigid material and has a size larger than a human eye socket. Each lens 1 includes a main portion 11 and an engaging portion 12 (in the form of an annular flange in this embodiment), which will be described later.

Each frame 2 is made of a soft material and includes a ring portion 21 having a receiving compartment (not labeled) for receiving an associated lens 1. A connecting portion 22 is formed between and thus connects the ring portions 21. Each frame 2 further includes a padding portion 23 in an inner side thereof. The two padding portions 23 have a space 24 therebetween, the space 24 being located corresponding to the wearer's nose. Each padding member 23 has an engaging portion 25 for engaging with the engaging portion 12 of an associated lens 1. It is noted that each padding member 23 has a size larger than the wearer's eye socket so as to be in intimate contact with an area surrounding the eye socket.

Figure 3:
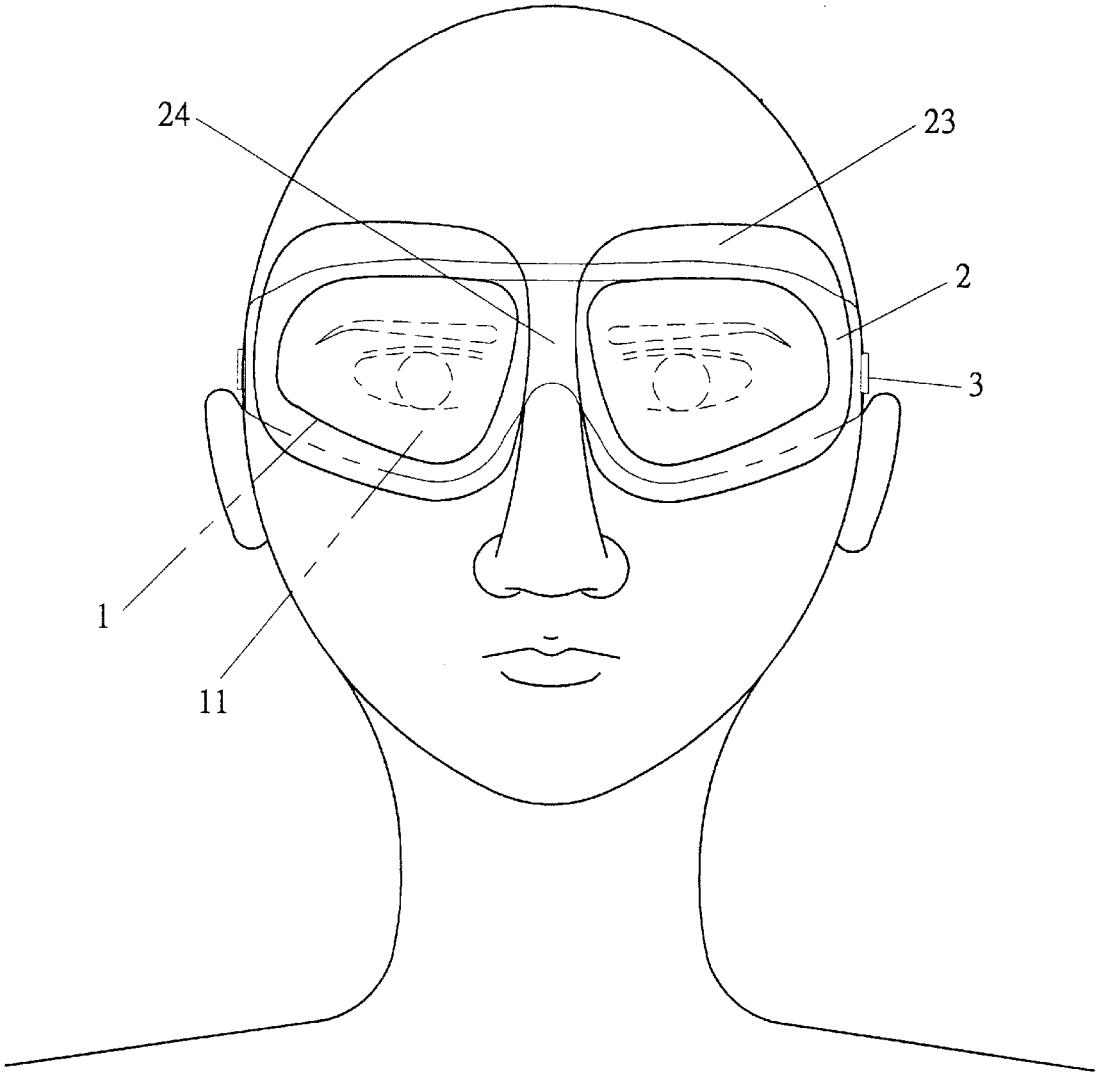
FIG. 3 is a schematic front view illustrating use of the pair of swimming goggles in FIG. 2.
Figure 4:
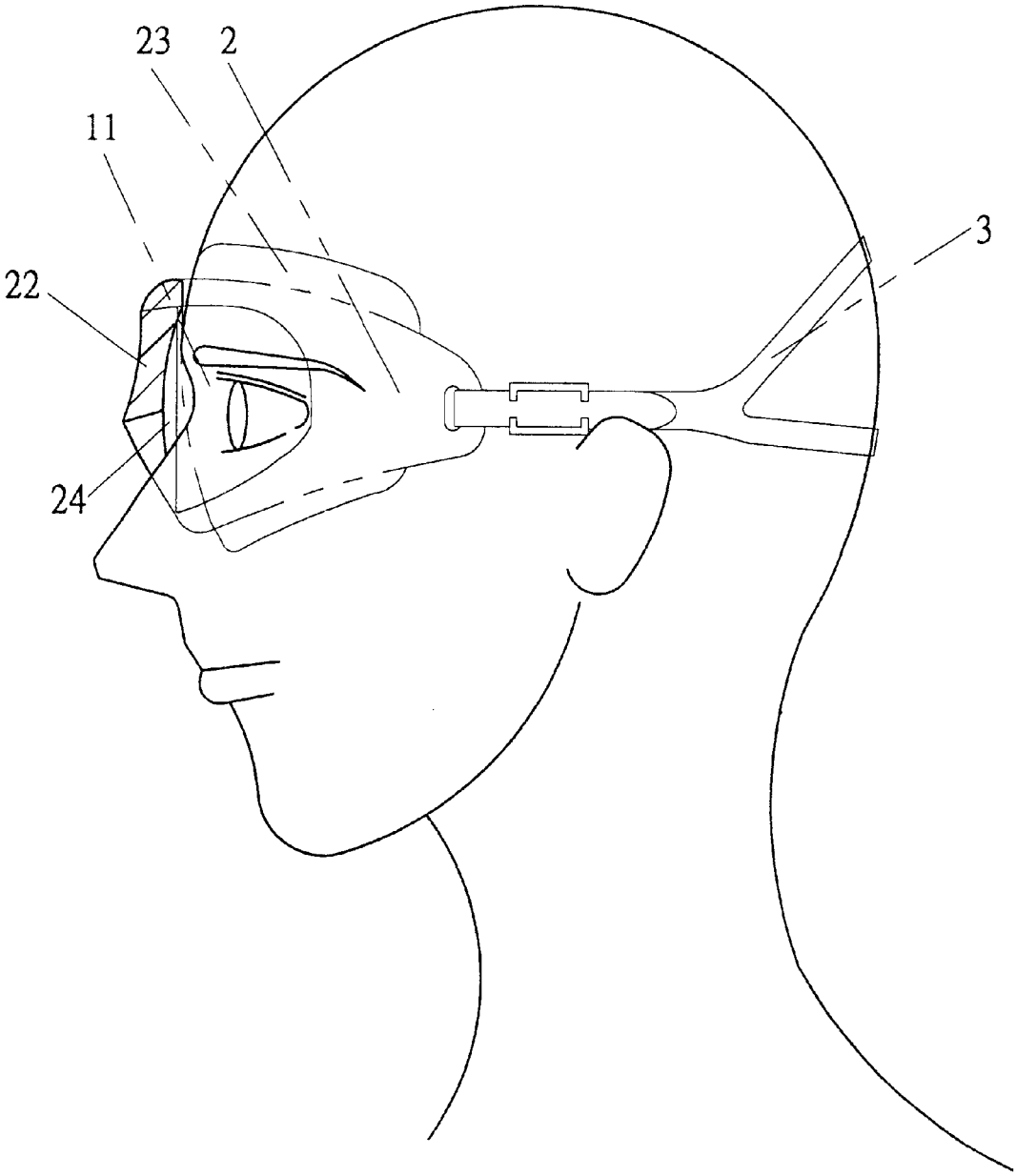
FIG. 4 is a schematic side view illustrating se of the pair of swimming goggles in FIG. 2.

In use, as illustrated in FIGS. 3 and 4, the lenses 1 and the frames 2 are larger than the wearer's eye sockets such that each padding portion 23 is in intimate contact with an area surrounding an associated eye socket of the wearer. Since the nerves in the area surrounding the eye socket are less sensitive, the wearer will not feel too much pressure and thus feel comfortable even after long-term wearing of the pair of swimming goggles.

In addition, there is a space 24 between the two padding portions 23 such that the padding portions 23 do not contact with the wearer's nose when wearing the pair of swimming goggles. In addition, the padding portions 23 are in intimate contact with lateral nose areas of the wearer those have low profiles. Thus, the pair of swimming goggles can be used by users having different nose profiles in addition to the advantage of improved waterproof characteristic.

Figure 5:
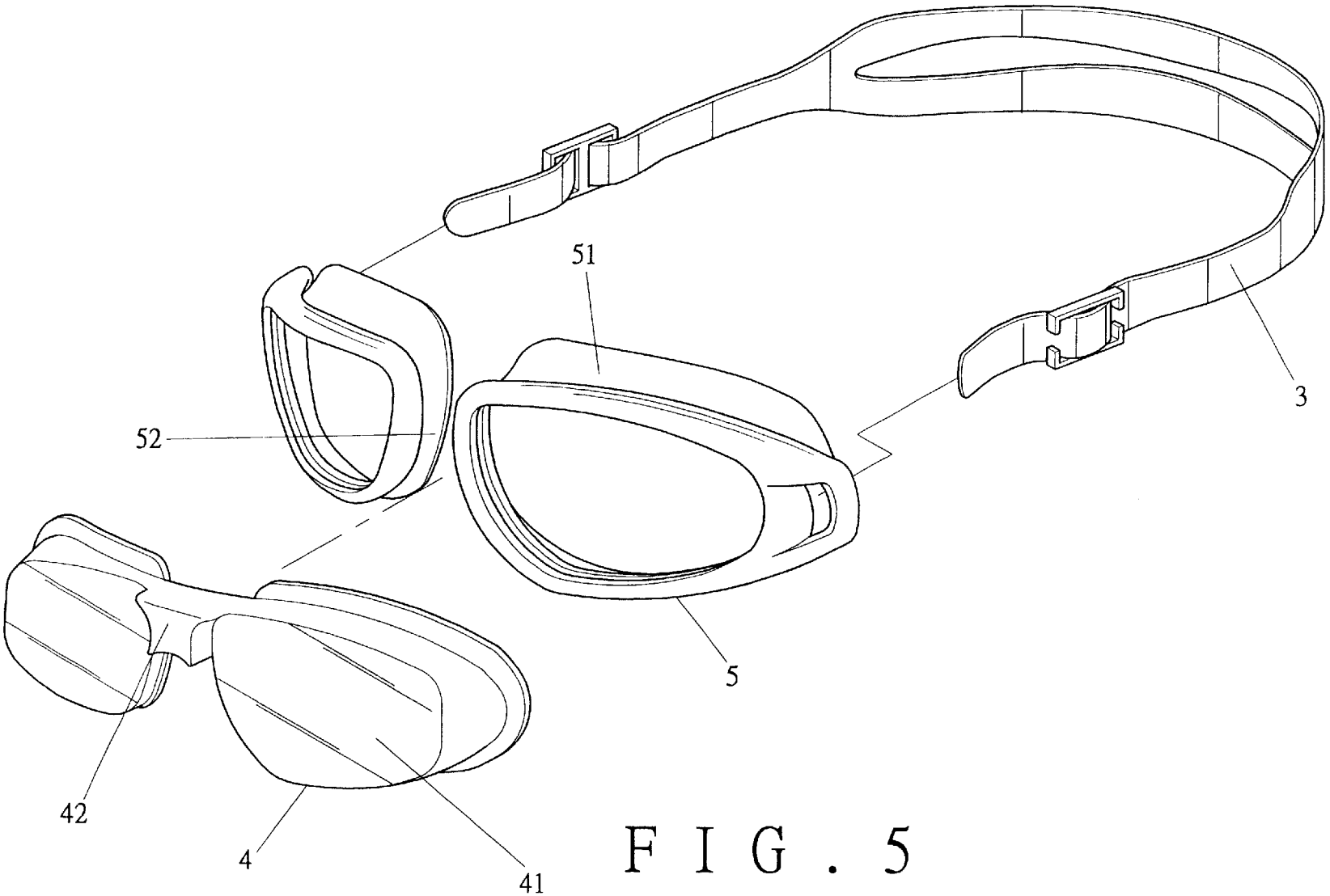
FIG. 5 is an exploded perspective view of a modified embodiment of the pair of swimming goggles in accordance with the present invention.
Figure 6:
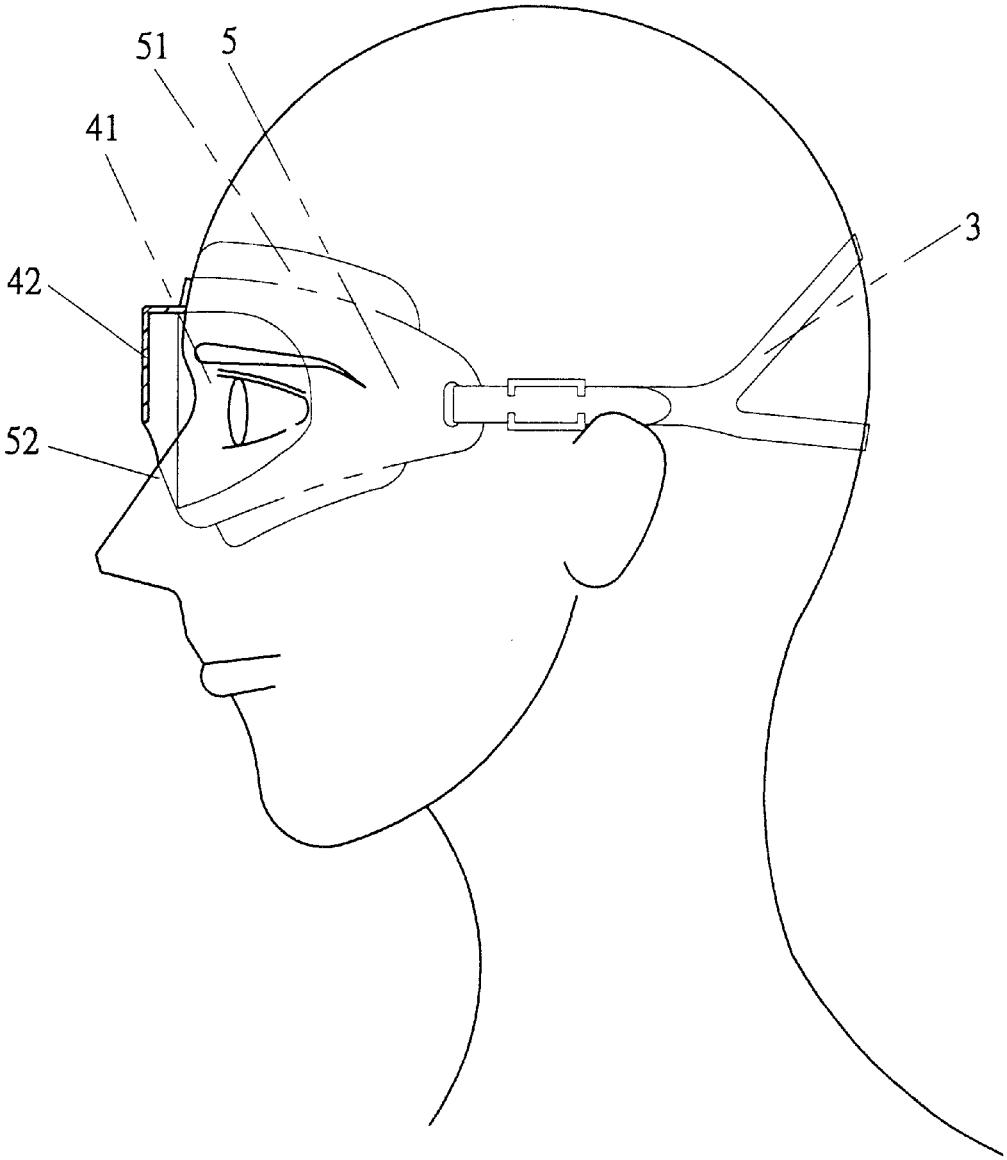
FIG. 6 is a schematic side view, partly sectioned, illustrating use of the pair of swimming goggles in FIG. 5.
Figure 7:
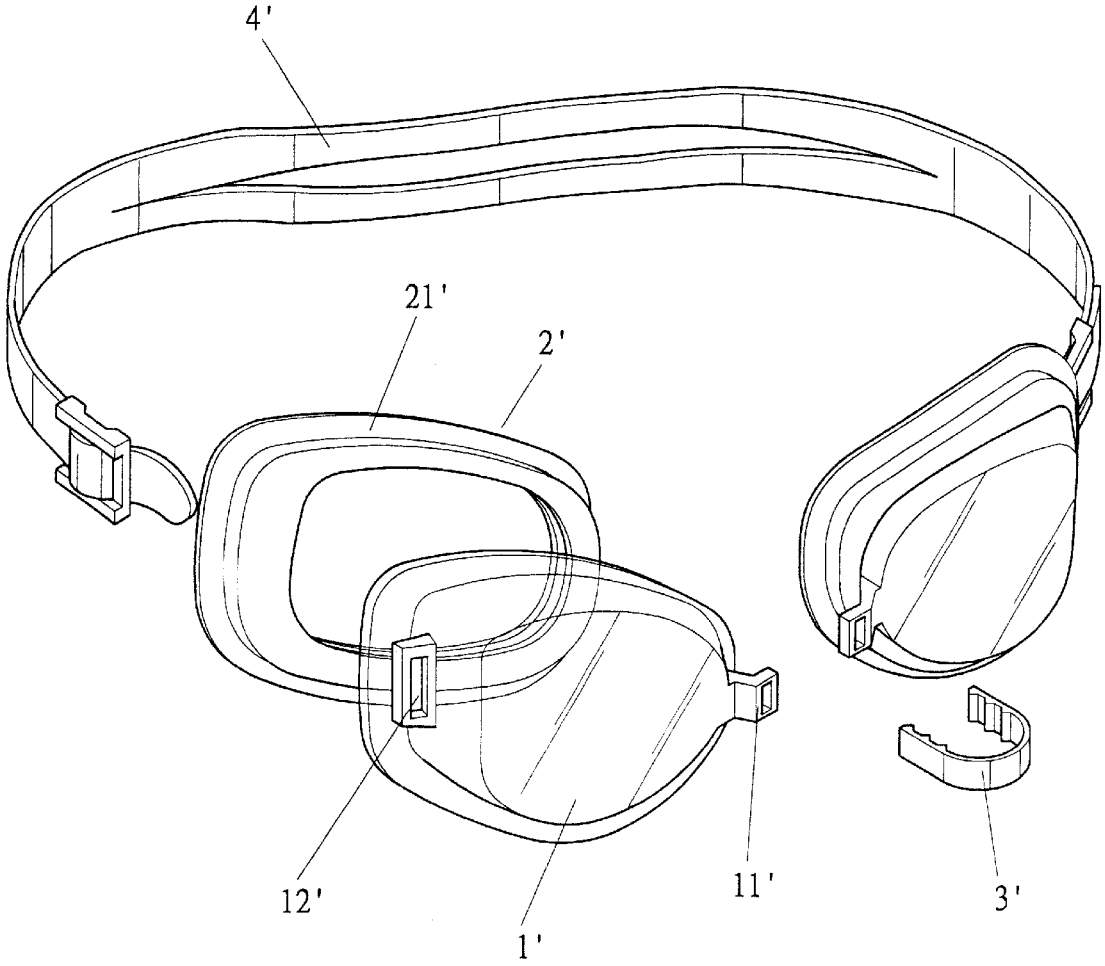
F I G . 7(PRIOR ART)
FIG. 7 is an exploded perspective view of a pair of conventional swimming goggles.
Figure 8:
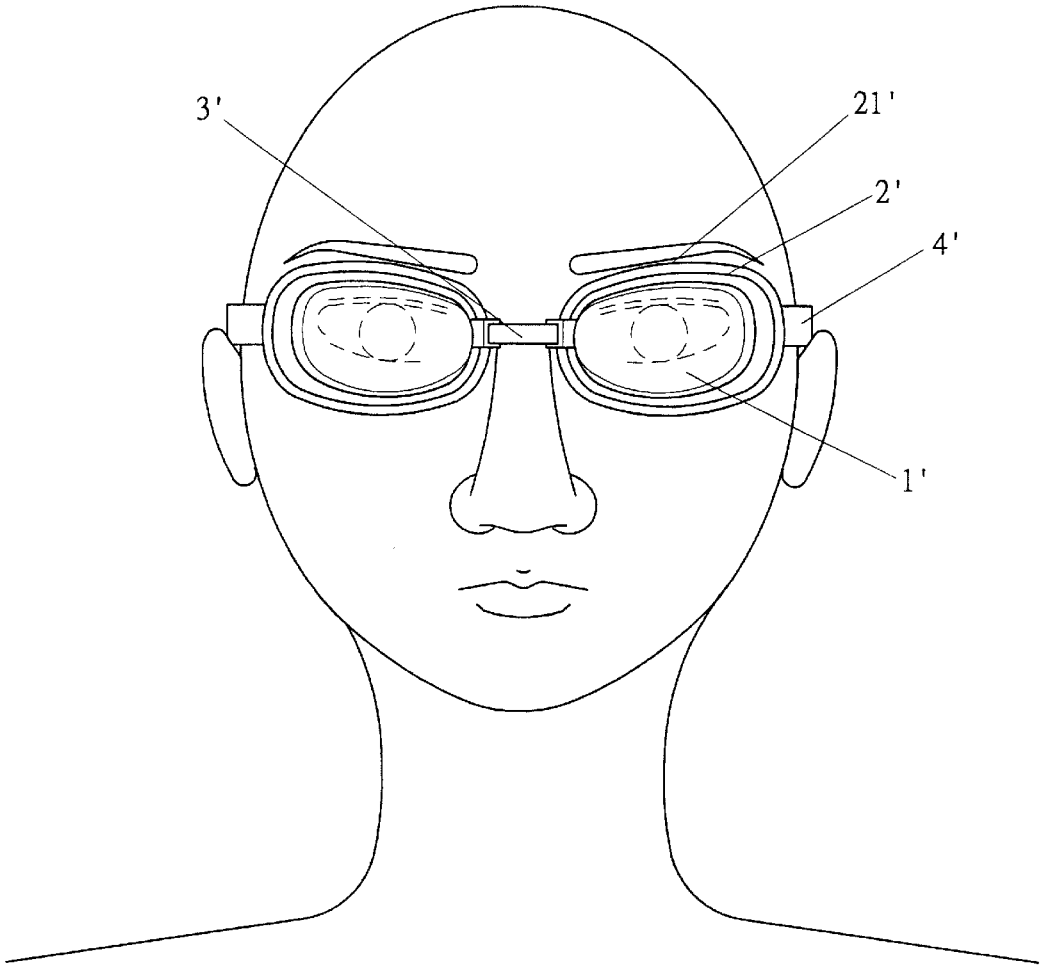
F I G . 8(PRIOR ART)
FIG. 8 is a schematic front view illustrating use of the pair of swimming goggles in FIG. 7.
Figure 9:
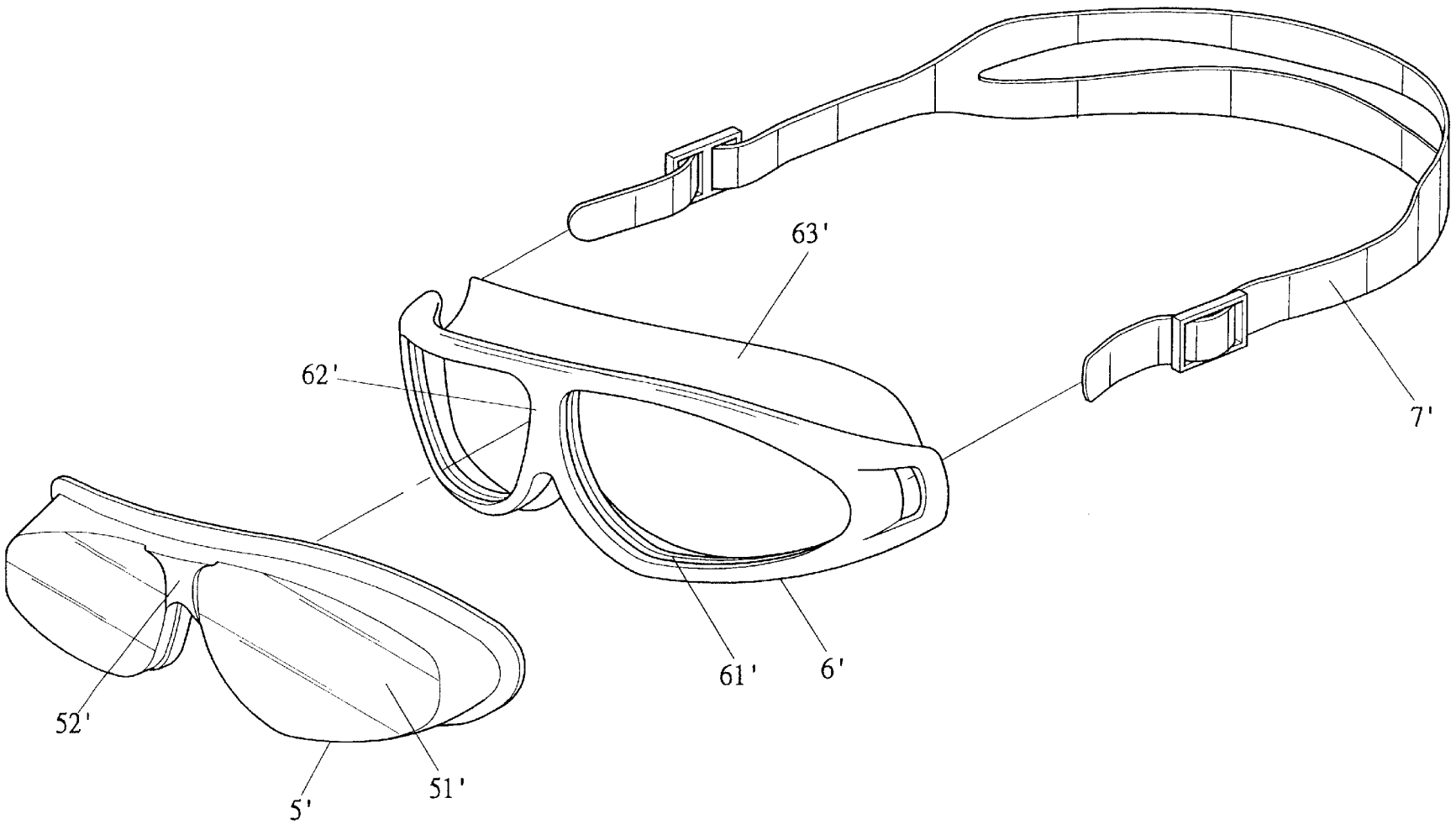
FIG. 9(PRIOR ART)
FIG. 9 is an exploded perspective view of another pair of conventional swimming goggles.
Figure 10:
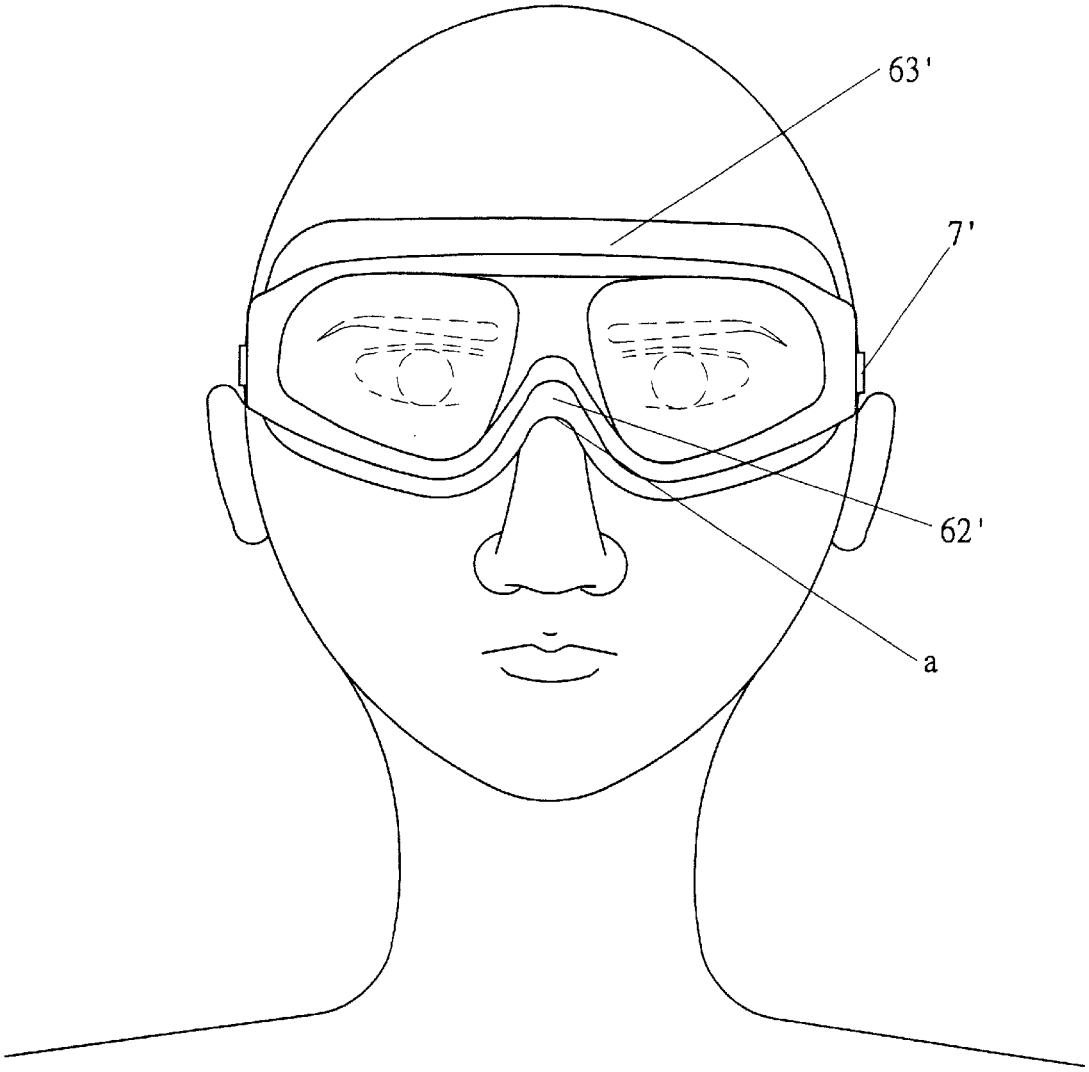
F I G . 10(PRIOR ART)
FIG. 10 is a schematic front view illustrating use of the pair of swimming goggles in FIG. 9.
Figure 11:
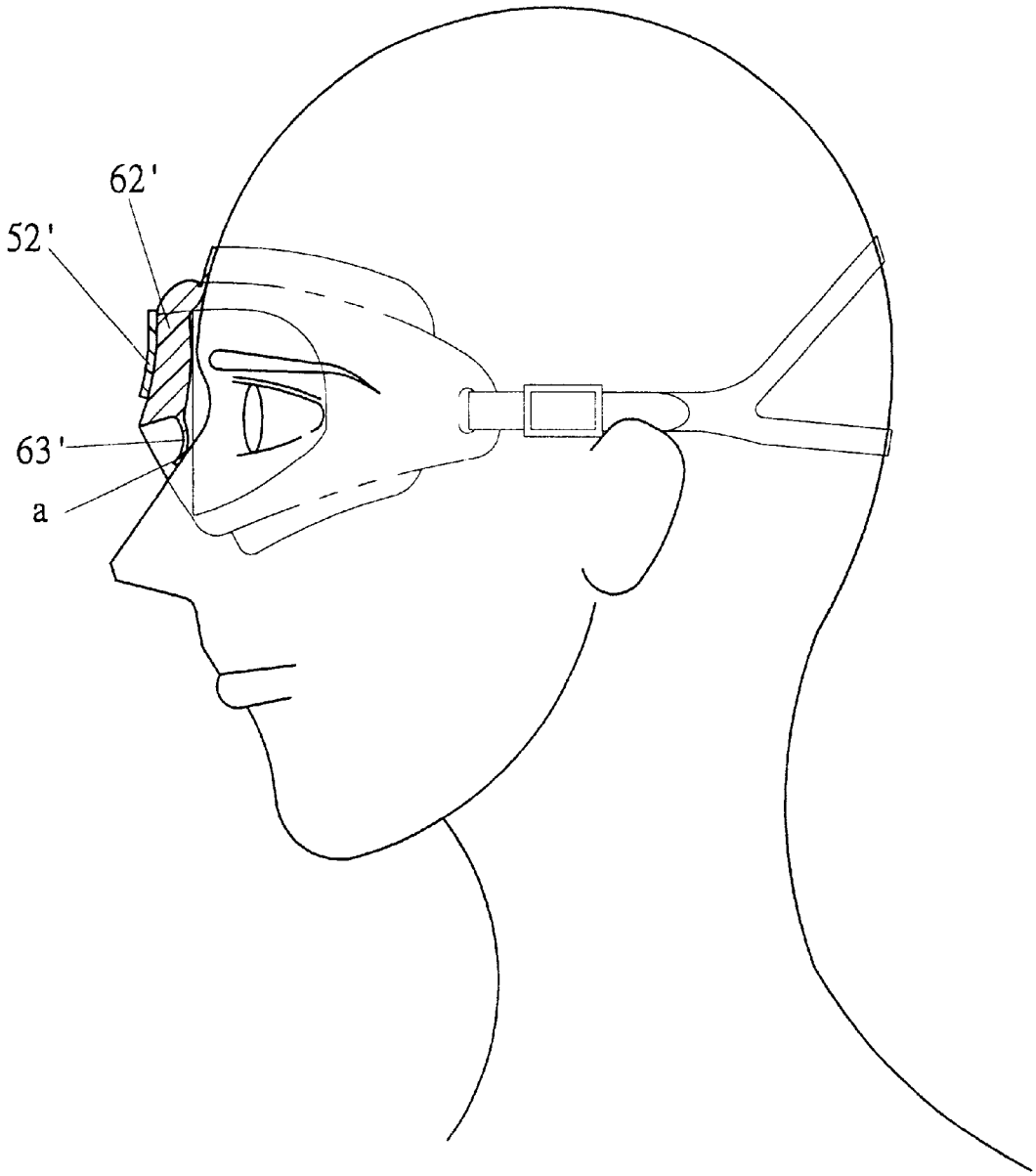
F I G . 11(PRIOR ART)
FIG. 11 is a schematic side view, partly sectioned, illustrating use of the pair of swimming goggles in FIG. 9.

FIGS. 5 and 6 illustrate a modified embodiment of the pair of swimming goggles in accordance with the present invention, wherein a connecting portion 42 is provided to connect the main portions 41 of two lenses 4, thereby forming a lens unit. In addition, each padding portion 51 is integrally formed with the associated frame 5 with a space 52 defined between the padding portions 51. Thus, the padding portions 51 do not contact with the wearer's nose when wearing the pair of swimming goggles. A pair of swimming goggles with improved wearing comfort and wider application is thus provided.

According to the above description, it is appreciated that the padding portions of the pair of swimming goggles in accordance with the present invention are in intimate contact with the lateral nose areas that have lower profiles, thereby preventing discomfort resulting from long-term wearing of the pair of swimming goggles and providing improved waterproof effect. In addition, the pair of swimming goggles in accordance with the present invention can be used by users having different nose profiles.

Although the invention has been explained in relation to its preferred embodiment, it is to be understood that many other possible modifications and variations can be made without departing from the scope of the invention as hereinafter claimed.

What is claimed is:

1. A pair of swimming goggles for use by a human wearer with a face, two eye sockets and a nose having a bridge portion, the goggles comprising:

two lenses each made of rigid material and each including a main portion and an engaging portion, each of the main portions being larger than one of said eye sockets; and two frames made of soft material and connected to each other by a connecting portion therebetween, each said frame including a ring portion for receiving the main portion of an associated one of said lenses, each said frame further including a padding and sealing portion on an inner side thereof relative to the wearer, the padding and sealing portion being engaged with the engaging portion of an associated said lens and being larger than an associated one of said eye sockets, the two padding and sealing portion located apart from each other to define a space therebetween adapted to receive the bridge of the wearer's nose in spaced relationship from the connecting portion;

wherein each said padding and sealing members is positionable in intimate contact with an area of the wearer's face surrounding the associated said eye socket and a lateral nose area of the wearer and not in contact with the bridge portion of the wearer's nose.

2. A pair of swimming goggles for use by a human wearer with a face, two eye sockets and a nose having a bridge portion, the goggles comprising:

two lenses each made of rigid material and connected to each other by a connecting portion therebetween, each said lens being larger than one of said eye sockets; and two frames made of soft material, each said frame receiving an associated one of said lenses, each said frame further including a padding and sealing portion on an inner side thereof relative to the wearer, the padding and sealing portion being larger than an associated said eye socket, the two padding and sealing portions located apart from each other to define a space therebetween adapted to receive the bridge of the wearer's nose in spaced relationship from the connecting portion;

wherein each said padding and sealing member is positionable in intimate contact with an area of the wearer's face surrounding the associated said eye socket and a lateral nose area of the wearer and not in contact with the bridge portion of the wearer's nose.

* * * * *